US007051537B2

(12) United States Patent
Ingham

(10) Patent No.: US 7,051,537 B2
(45) Date of Patent: May 30, 2006

(54) METHOD AND APPARATUS FOR CARBON DIOXIDE ACCELERATED REACTOR COOLDOWN

(75) Inventor: Bradley Cyril Ingham, Edmonton (CA)

(73) Assignee: BJ Services Company, Houston, TX (US)

( * ) Notice: Subject to any disclaimer, the term of this patent is extended or adjusted under 35 U.S.C. 154(b) by 6 days.

(21) Appl. No.: 10/738,238

(22) Filed: Dec. 17, 2003

(65) Prior Publication Data

US 2005/0132722 A1 Jun. 23, 2005

(51) Int. Cl.
*F17C 7/02* (2006.01)
*F17C 9/02* (2006.01)

(52) U.S. Cl. ..... 62/52.1; 62/50.2

(58) Field of Classification Search ..... 62/52.1, 62/50.2

See application file for complete search history.

(56) References Cited

U.S. PATENT DOCUMENTS

| | | | | |
|---|---|---|---|---|
| 4,149,876 | A * | 4/1979 | Rerat | 75/363 |
| 5,059,407 | A * | 10/1991 | Wallace et al. | 423/421 |
| 5,172,555 | A * | 12/1992 | Schmidtke | 62/50.2 |
| 5,261,243 | A * | 11/1993 | Dunsmore | 62/52.1 |
| 5,321,946 | A | 6/1994 | Abdelmalek | |
| 5,763,544 | A | 6/1998 | Cheng et al. | |
| 5,847,246 | A | 12/1998 | Hsu et al. | |
| 5,943,869 | A | 8/1999 | Cheng et al. | |
| 6,044,648 | A * | 4/2000 | Rode | 62/62 |
| 6,324,852 | B1 * | 12/2001 | Cheng | 62/52.1 |
| 6,742,342 | B1 * | 6/2004 | Bonaquist et al. | 62/52.1 |

* cited by examiner

*Primary Examiner*—William C. Doerrler
(74) *Attorney, Agent, or Firm*—Locke Liddell & Sapp LLP

(57) ABSTRACT

A system and a method of its use for the accelerated cooldown of at least one reactor by injecting liquid carbon dioxide via a sparger into a pipeline connected to the reactor via a access valve upstream of the reactor. By providing an evenly distributed flow into the system gas prior to entry into the reactor, the system and its method of use efficiently and uniformly cooldown the reactor. In a preferred embodiment, multiple spargers using this technique can cooldown multiple reactors in series.

20 Claims, 8 Drawing Sheets

METHOD AND APPARATUS FOR CARBON DIOXIDE ACCELERATED REACTOR COOLDOWN

FIELD OF THE INVENTION

The present invention and its method of use are applicable to reactor systems that benefit from shortened cooldown periods during shutdown, namely reactors with high operational temperatures.

BACKGROUND OF THE INVENTION

Reactors have a fairly slow rate of cooldown from operational temperatures. In order to maintain a reactor safely, the reactor must be cooled to a temperature that will allow maintenance workers to open and interact with the reactor. Given the costs associated with downtime with these vessels and reactors, a need exists to cooldown reactors in an accelerated manner.

Vessel reactor systems have benefited from accelerated cooldown services. Typically this process is done in one of two ways. First, cool nitrogen gas can be passed through a reactor system. As the gas moves though the reactor, it exchanges heat with any matter it comes into contact with, causing a faster than normal, or accelerated cooldown. In the alternative, cryogenic nitrogen fluid has been pumped into the gas stream within a specially designed reactor system. The nitrogen is vaporized by the warm gas stream and forms mixed gas at a lower temperature. This cool gas mixture is used in the same manner as the gaseous cooldown to accelerate the cooling of the reactor system.

In order to create the cool gas required for a gaseous cooldown, the cryogenic liquid nitrogen is vaporized and heated to a temperature that can be tolerated by the metallurgy of the reactor in question. The efficiency of a liquid cooldown is higher, because the energy to vaporize and heat up the gas from an extremely cold temperature are extracted from the reactor and not injected by the nitrogen equipment. As a general rule a cooldown with liquid is about 3.5 times more efficient than a gas cooldown. As a result it costs less than about 30% to cooldown a reactor with liquid as compared to gas.

There are several limitations with the liquid cooldown that restrict its application with in industry. The metallurgy of the system must be compatible with cryogenic temperatures. Pipes made from stainless steel with high nickel content can tolerate liquid nitrogen temperature. Moreover, the system must have a carrier gas in order to vaporize and carry the gas mixture throughout the reactor system. Furthermore, a system that recycles its gas can more fully utilize the cooling power of the liquid. Finally, cryogenic liquid will destroy most reactor systems if not properly sparged and mixed.

There are also limitations on gas cooldown methods. The limiting factor in gas cooldown methods is the amount of product required to cool down any substantial reactor. It is the transport of the liquid to site which is more of a factor than the bulk cost of the nitrogen. This creates an effective radius of application. Beyond this radius, while accelerating the cooling of a reactor is attractive, the costs of doing the operation out weigh the benefits in all but the most extreme situations. Therefore, a need exists to accelerate the cooldown of reactors and vessels using a liquid medium that does not require the application of expensive cryogenic piping in a method that will not damage the carbon steel of these systems.

The prior art has only used carbon dioxide that was actually injected right into the reactor to control the temperature of an exothermic reaction. Direct injection into a reactor or similar vessel does not produce good flow characteristics during shutdown. Without even distribution of a cooldown medium, the cooldown of the reactor will take longer. There exists a need to be able to take advantage of the open space, preferably with a high velocity gas, by putting it into the feed pipe of the reactor. Moreover, a need still exists for a system and a method of its use that will allow for using existing piping to provide for well distributed cooling method using the existing pipeline to accelerate the cooldown of a reactor during downtime and maintenance rather than attempting to control the reaction itself. The prior art has failed to offer an efficient and safe manner of accelerating the cooldown of a reactor so that the reactor will be safe to enter as quickly as possible.

SUMMARY OF THE INVENTION

The present invention offers the advantage of providing a well-mixed, cool gas coming into the actual reactor that is more evenly distributed versus just adding a localized spot within the reactor that is cool as found in the prior art. By sparging liquid carbon dioxide into a system gas upstream of the reactor, the present invention offers the ability to provide accelerated cooldown of a reactor system with minimal impact on the configuration of the reactor. Moreover, the present invention offers the ability to include multiple spargers capable of simultaneously cooling down multiple reactors located in series. By using the valves within the existing system, the present invention does not require extensive retrofit of existing systems.

The present invention offers a system and a method of its use for the accelerated cooldown of at least one reactor including a pipeline connected to the reactor having at least one access valve upstream of the reactor and routes a flow of system gas to the reactor, a sparger inserted through the access valve, wherein the sparger comprises at least one nozzle positioned within the pipeline, a source of liquid carbon dioxide capable of being delivered into the pipeline via the sparger wherein the liquid carbon dioxide is evenly distributed in the flow of system gas prior to entry into the reactor, and at least one temperature gauge in contact with the pipeline between the access valve and the reactor. In a preferred embodiment, the sparger may include a flow meter, a pressure gauge, a pump connecting it to the liquid carbon dioxide source, a surge suppressor, and/or an injection skid. In a most preferred embodiment, the sparger includes a plurality of nozzles. The nozzles may be aligned with the flow of system gas and/or against the flow of system gas. This system is also applicable to a plurality of reactors in series wherein the present invention may accelerate the cooldown of these multiple reactors with a plurality of spargers.

BRIEF DESCRIPTION OF THE DRAWINGS

The accompanying drawings, which are incorporated in and form a part of the specification, illustrate the embodiments of the present invention, and, together with the description, serve to explain the principles of the invention. In the drawings.

It is to be noted that the drawings illustrate only typical embodiments of the invention and are therefore not to be considered limiting of its scope, for the invention encompasses other equally effective embodiments.

DETAILED DESCRIPTION O PREFERRED EMBODIMENT

Carbon dioxide exists as a liquid at pressures and temperatures that do not require the application of expensive cryogenic piping. Once the pressure is taken off of the liquid it will quickly form an 80/20 mixture of gas and snow at −75° C. If the liquid can be expanded without chilling the piping system, it can be used to cool down carbon steel systems. By taking advantage of the physical characteristics of carbon dioxide and its availability and relative simplicity of use, carbon steel piping may be protected from frosting while providing accelerate cooldown to reactors. The present invention can achieve a target temperature in a mixed gas at a sufficient rate to cool the system gas down to the target temperature. By continuously monitoring and adjusting that flow rate to compensate for changes in the system gas, the present invention can cooldown a reactor system. By forming at least one sparger with a nozzle configuration and flow rate that does not form ice plugs, the operation may be conducted safely.

Figure 1:
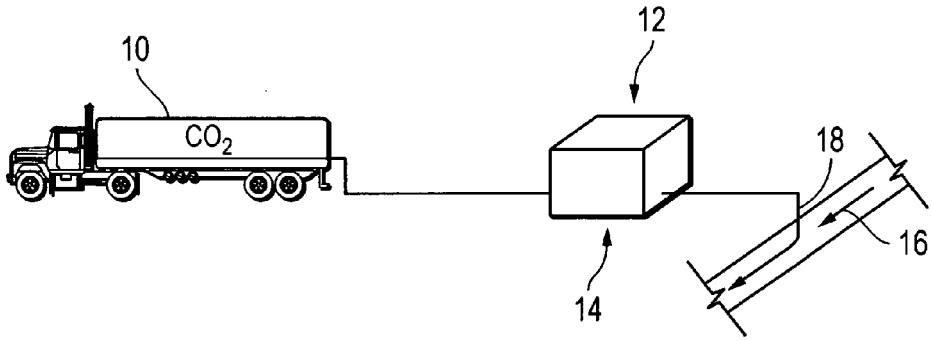
FIG. 1 shows a diagram of a basic injection system using a preferred embodiment of the present invention.

FIG. 1 shows a diagram of a basic injection system using a preferred embodiment of the present invention. Liquid carbon dioxide is provide from a supply 10, such as a tanker or similar vehicle, through a pump 12, located on an injection skid 14, which is then introduced into the system gas in the pipeline 16 via a sparger 18. As shown herein, the pump 12 boosts the pressure of the liquid carbon dioxide by air-driven or electrically-driven means. The injection skid 14 is shown in greater detail in FIG. 2. Those skilled in the art will recognize that the skid 14 is optional in some embodiments of the invention.

Figure 2:
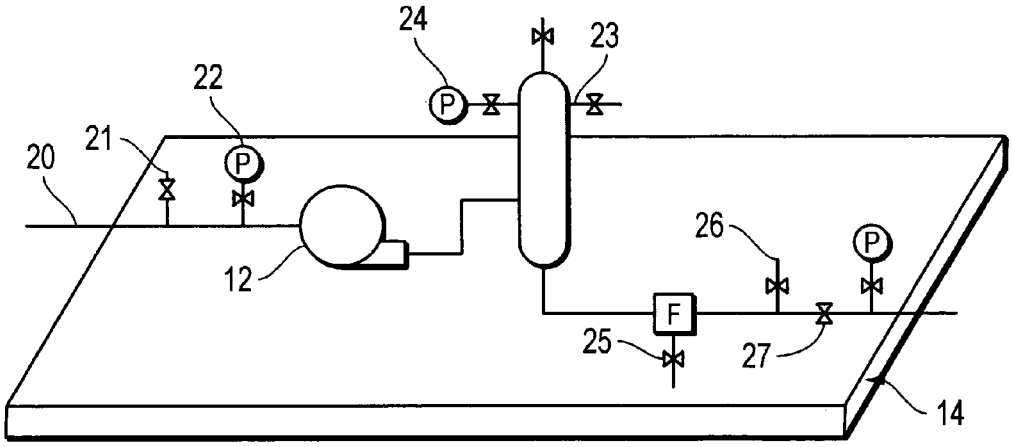
FIG. 2 is a diagram of a preferred embodiment of an injection skid of the present invention.

As shown in FIG. 2, the injection skid 14 allows for the line 20 coming from the supply 10 (not shown) to pass by a bleed off valve 21 and a pressure indicator 22 before reaching the pump 12. It is preferable to bleed off carbon dioxide as close to the discharge point as possible. Otherwise, if the pressure is allowed to drop, the liquid carbon dioxide will form into ice. If the carbon dioxide forms into ice, it can expand and damage the pipes of the system. The pump 12 is preferably capable of boosting the pressure in the line to a pressure in the range of about 90 psi to about 800 psi. In a preferred embodiment, the boosted pressure is in the range of about 250 psi to about 350 psi.

In this configuration, a surge suppressor 23 is connected after the pump 12. The surge suppressor 23 may be pressure cylinder which could be filled with nitrogen gas prior to the introduction of the liquid carbon dioxide. When the liquid carbon dioxide is introduced into the surge suppressor 23, the nitrogen is forced to the top of the surge suppressor 23. This arrangement, which can be monitored on the surge suppressor pressure indicator 24, allows an operator to control the pressure of the system and remove any jitter, noise, and rattling that the pump 12 may cause. The liquid flow meter 25 connected to the exit of the surge suppressor 23 is used to monitor the carbon dioxide injection rate during operation. Another bleed off valve 26 is connected beyond the liquid flow meter 25 before the primary shutoff valve 27.

Figure 3:
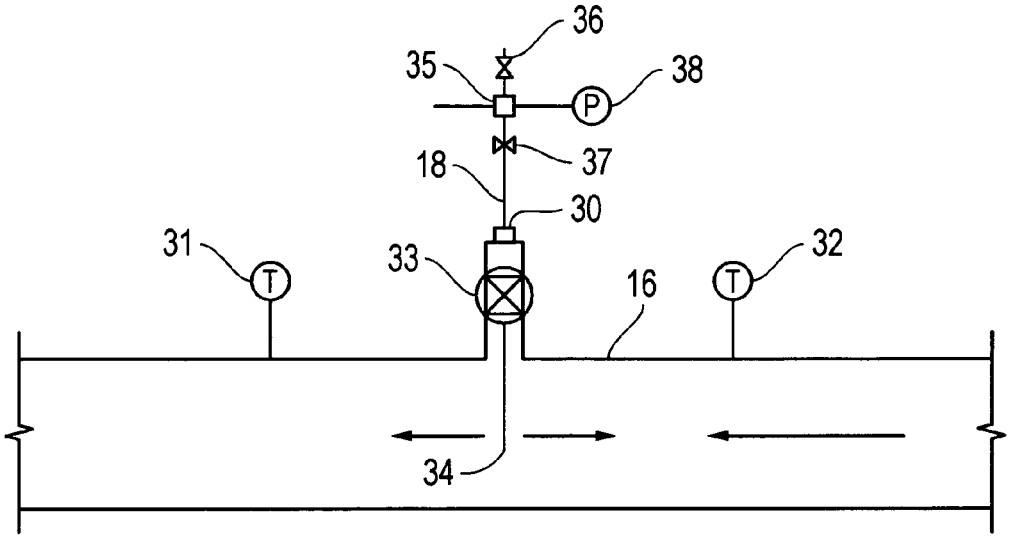
FIG. 3 is a diagram of an embodiment of injection into an existing pipe of a representative system.

FIG. 3 shows an embodiment of the sparger 18 inserted into the pipeline 16 via a dynamic seal 30. In a preferred embodiment, the dynamic seal 30 is made of modified swage lock fitting with a Teflon seal.

If the pipeline 16 does not include devices for temperature measurements near the insertion point of the sparger 18, the insulation surrounding the exterior of the pipeline may be removed and at least one temperature sensor 31, 32 may be placed on the surface of the pipeline 16. As shown, the sparger 18 may be inserted through a pipeline valve 33, but the dynamic seal 30 allows for maintenance of the pressure in the pipeline 16. The insertion end 34 of the sparger 18 should be centered in the system gas passing through the pipeline 16.

During operation, the liquid carbon dioxide enters under pressure from the left in this configuration into the T-connection 35. The T-connection shown herein is connected to a vent valve 36 at the top of the T-connection 35 and an injection control valve 37 at the bottom of the T-connection 35. A pressure indicator 38 is also located on the T-connection 35 to monitor changes in pressure based on the position of the valves 36, 37 and the incoming liquid carbon dioxide.

The injection control valve 37 in the embodiment shown herein is a full bore valve with the same diameter as the sparger 18 suitable for controlling fluid flow. Because it is used to control flow, valves including globe valves or needle valves are preferable over ball valves and butterfly valves. The sparger 18 size is dependent on the size of the pipeline 16 and the amount of system gas passing through the pipeline 16. It is envisioned that the sparger size may be of any size that may be accommodated by the size of the pipeline valve 33.

The temperature indicators or probes 31 and/or 32 are visually monitored to verify that the cooldown process is not chilling the metal of the pipeline to an undesirable temperature. The feedback from these indicators can be fed to the injection skid 14 to control shutdown if necessary. In a preferred embodiment, an emergency shutdown would be computer controlled to avoid frosting the pipeline. In this configuration, frosting would occur at about −20° F. Negative 20° F. is the lowest temperature that the operator can take a piece of carbon steel pipe of regular specifications. Therefore, it is desirable to operate such that the pipeline 16 operates at about −20° C., which is about minus 5° F.

Though this is a preferred temperature, those skilled in the art will recognize that any temperature above the frosting temperature of the pipeline 16 is possible. In one embodiment, a monitor would set off a first warning light at minus 10° F. and at minus 15° F. would shut down the system automatically.

The position of the sparger 18 within the pipeline 16 should be such that the insertion end 34 of the sparger is positioned in the stream of system gas rather near the interior surface of the pipeline 16. If the sparger 18 is not positioned properly, carbon dioxide may be sparged directly into the interior surface of the pipeline 16 rather than into the system gas, increasing the chances of frosting the pipeline 16.

The direction of sparging varies. In certain circumstances and with certain system gases, sparging will spray into the system gas flow. In other circumstances, sparging will spray with the system gas flow. In fact, it is envisioned that in some embodiments, sparging with and into the system gas flow simultaneously is advantageous. It should be noted that a variety of system gases, including fuel gas, air, nitrogen, acid gas, steam, and furnace exhaust, are compatible with the present invention.

Liquid carbon dioxide converts itself to about 95% gas as soon as it is sparged into the pipeline 16. This conversion lowers the temperature of the carbon dioxide from about 70° F. to about minus 114° F. In the preferred embodiment, the liquid carbon dioxide is under pressure until the point of discharge from the sparger 18. At that point, it rapidly converts itself into a mixture of gas and carbon dioxide snow at a greatly reduced temperature.

Figure 4:
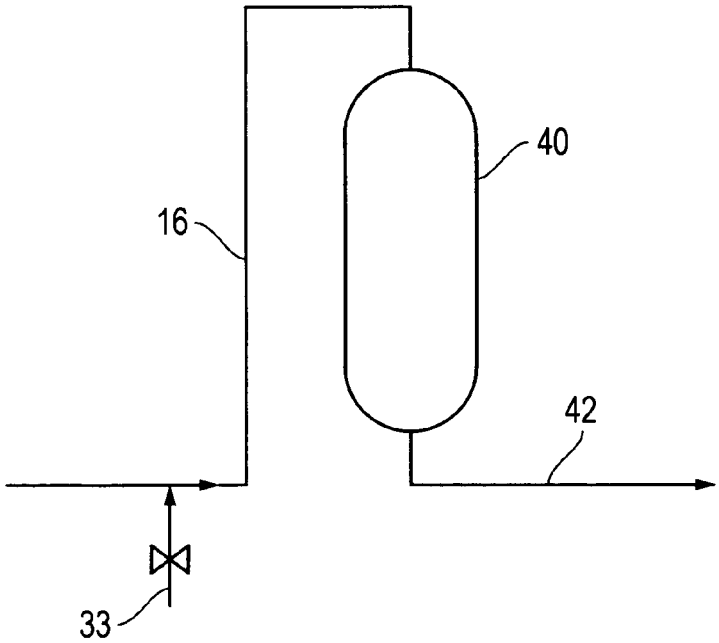
FIG. 4 is a diagram of an application of the invention with a single reactor cooldown scenario.

Turning to FIG. 4, a preferred application of a single reactor cooldown is shown. This is a basic diagram of using the present invention in conjunction with a single reactor 40. The system gas travels through pipeline 16 into the single reactor 40. Liquid carbon dioxide, using the sparger 18 is sparged into the pipeline 16 prior to reaching single reactor 40. It is preferable that the carbon dioxide thoroughly mixes with the system gas prior to introduction into the single reactor 40. This will maximize the ability of the carbon dioxide to cooldown the single reactor 40. It is preferable for the carbon dioxide to chill the system gas to about minus 20° C. prior to entering the single reactor 40. Temperature sensors particular to the injection will be on either side of the injection point on pipeline 16. Typically, at least one temperature sensor is located downstream of the point of sparging into the pipeline 16.

Though this diagram shows the single reactor 40, the vent 42 from the single reactor 40 may connect to other reactors in series that can benefit from the cooldown process. It is envisioned in one embodiment that a plurality of reactors in series may have an accelerated cooldown from the introduction of liquid carbon dioxide prior to the first reactor, such as single reactor 40 in this diagram. In another embodiment, a corresponding plurality of liquid carbon dioxide spargers will introduce liquid carbon dioxide before each reactor that is in the series. In this manner, the cooldown process for the entire series will occur in a short period. In these scenarios, each sparger should include a flow meter to account for the flow rate entering each reactor.

Figure 5:
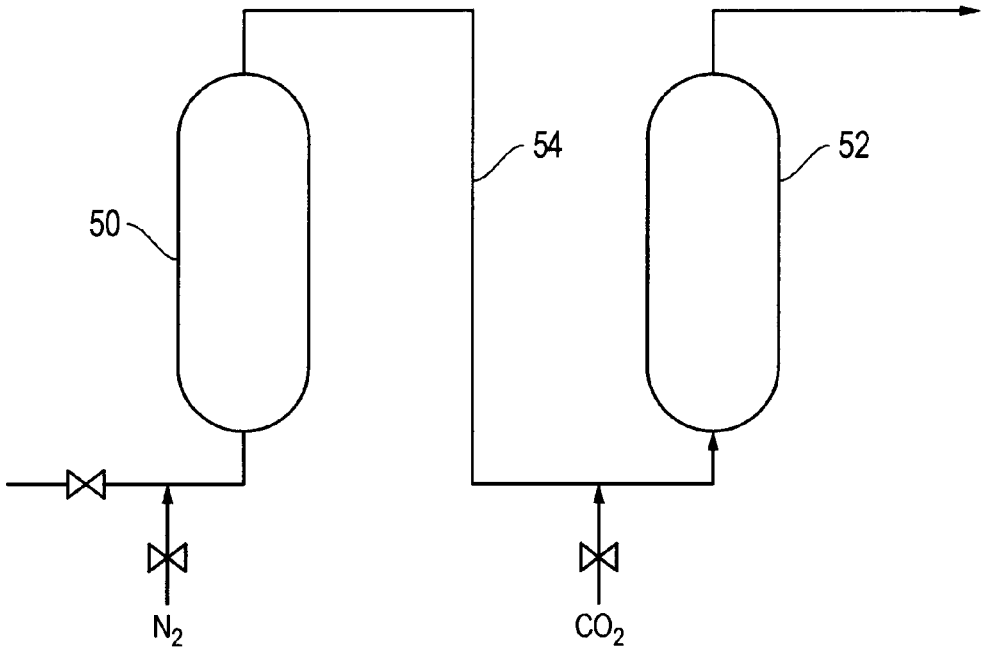
FIG. 5 is a diagram of a basic injection method using a hybrid gas cooldown embodiment of the present invention.

FIG. 5 shows a basic diagram of a hybrid gas cooldown system. In this system, a first reactor 50 and a second reactor 52 are shown in series. The pipeline 16 containing a system gas such as nitrogen gas is sparged with liquid carbon dioxide upstream of the first reactor 50. Though the system gas warms up as that reactor is cooled and warmer gas exits into pipeline 54 between the first reactor 50 and the second reactor 52, the system gas in pipeline 54 is sparged with additional carbon dioxide upstream of the second reactor 52. As before, these spargers should include flow meters to monitor the introduction of liquid carbon dioxide into the system.

EXAMPLE

Figure 6:
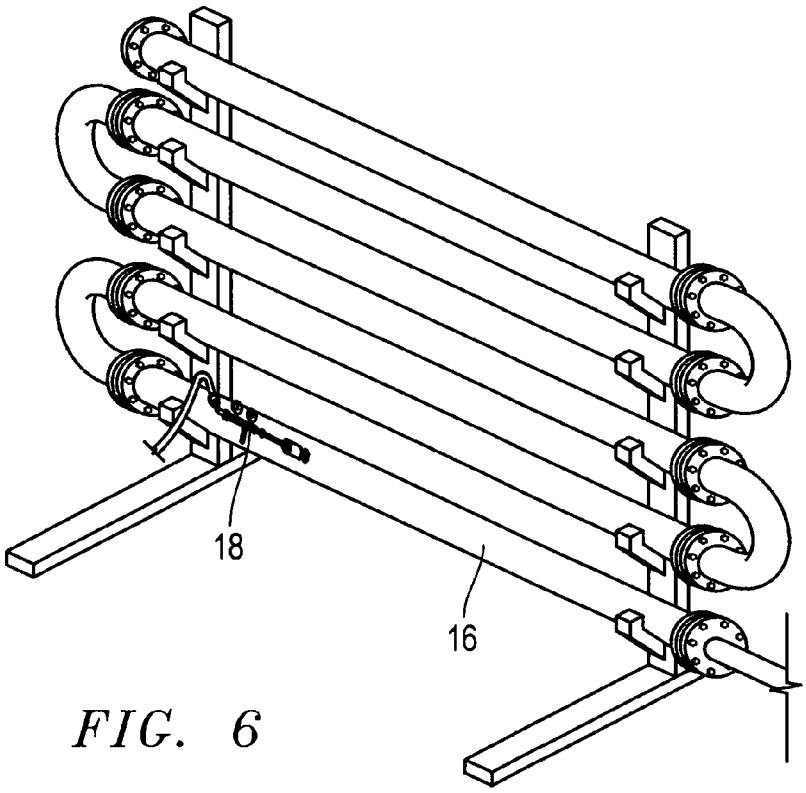
FIG. 6 is a drawing of an application of the present invention.

FIG. 6 shows a simulation of the cooldown of a pipeline 16. A bulker (not shown) was used to supply the sparger 18 with liquid carbon dioxide. The sparger 18 was set into to six inch furnace pipe rack to act as the pipeline 16. Temperatures of the gas upstream and downstream of the sparger 18 were measured. The system gas was nitrogen gas in this simulation. The nitrogen system gas was issued through the pipeline 16 at various temperatures and flow rates. Liquid carbon dioxide was injected with the sparger 18. With a single nozzle, which is discussed in greater detail below, the following data was recorded:

TABLE 1

COOLDOWN OBSERVATIONS

| Stem Pressure | $N_2$ In Temp | $N_2$ Flow Rate | Gas Temp D/S | $CO_2$ Flow Rate | Combined Rate/Temp |
|---|---|---|---|---|---|
| 260 psi | 83° C. | 25 $m^3$/min | −25° C. | 14 $m^3$/min | 39/−25° C. |
| 320 psi | 44° C. | 80 $m^3$/min | −25° C. | 29 $m^3$/min | 109/−25° C. |
| 320 psi | 56° C. | 80 $m^3$/min | −20° C. | 31 $m^3$/min | 111/−20° C. |
| 300 psi | 86° C. | 60 $m^3$/min | −3° C. | 24 $m^3$/min | 84/−3° C. |
| 300 psi | 73° C. | 50 $m^3$/min | −27° C. | 26 $m^3$/min | 76/−27° C. |

According to tank level measurements, during the entire test a total of 1000 L of liquid carbon dioxide (547 $m^3$ of gas) was used and 2900 $m^3$ of nitrogen gas was used. It is envisioned that at 80° C., the ratio of liquid carbon dioxide to nitrogen is 1:2. Accordingly, about 1 $m^3$ of liquid carbon dioxide will cool about 1100 $m^3$ of nitrogen system gas.

The orientation of the sparger indicates that a downstream sparger orientation is preferred. With a nitrogen rate of 50–60 $m^3$/min, the sparger 18 was rotated 180 degrees so that the spray was facing downstream. This resulted in less frosting around the injection point.

Returning to FIG. 6, the pipe rack was the pipeline 16 with the sparger 18 and two thermometers installed. Though those skilled in the art will recognize that virtually any pipeline may benefit from the teachings of this invention, the pipeline 16 in FIGS. 6–10 is a NPS6 inch pipe wherein the pipe sections are about 21 feet long with 2D 180 degree bends.

Figure 7:
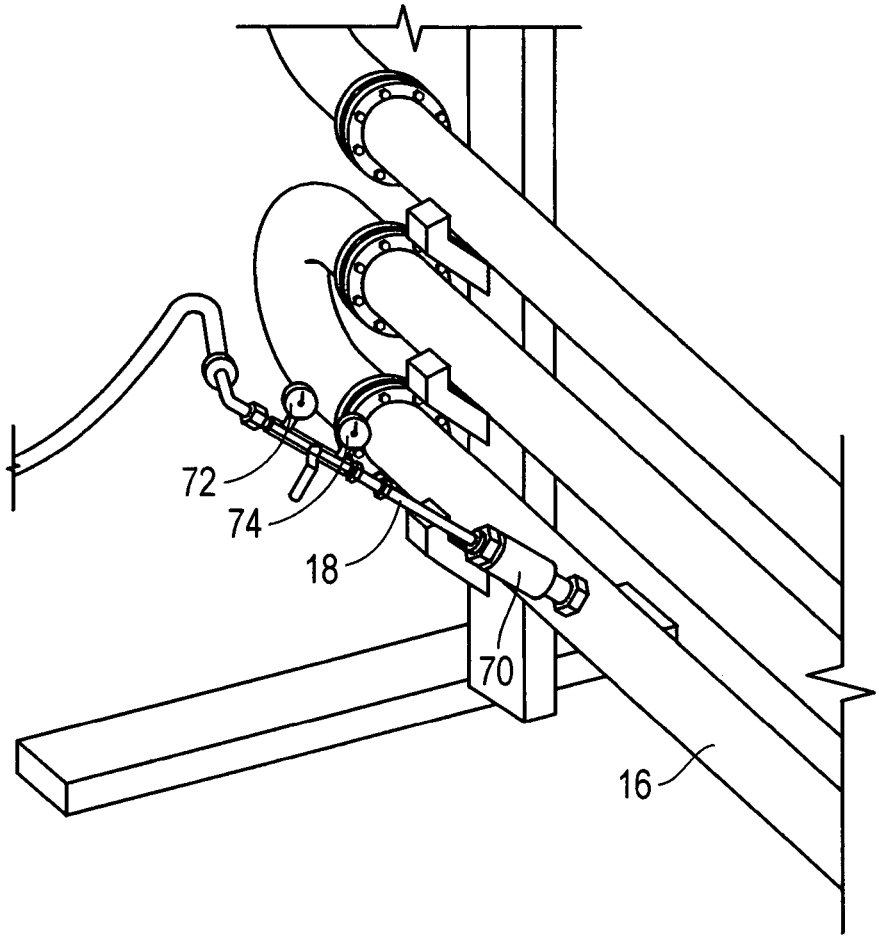
FIG. 7 is a close-up drawing of an embodiment of the present invention showing the insertion of a sparger into a pipeline.

FIG. 7 shows a close-up of a sparger 18 on pipeline 16, which is represented by a Sparger MKIb. The hose, leading from an injection skid shown in FIG. 8, was a one inch hose with a highest elbow changed from about ⅜ inches to about 0.75 inches in diameter. The distance from the bottom edge of the lowest nut on the stem to the centre of the middle sparger nozzle is about 22⅛ inches. This embodiment of the sparger 18 will fit through a 1.5 inch full bore valve, such as valve 70 shown in FIG. 7. Pressure gauges 72, 74 are shown on the sparger 18. Pressure gauge shows the pressure of the carbon dioxide supply 10. It is important to not deplete the supply 10 for the reasons stated above and the pressure gauge 74 allows for a measurement of the pressure put through the sparger 18.

Figure 8:
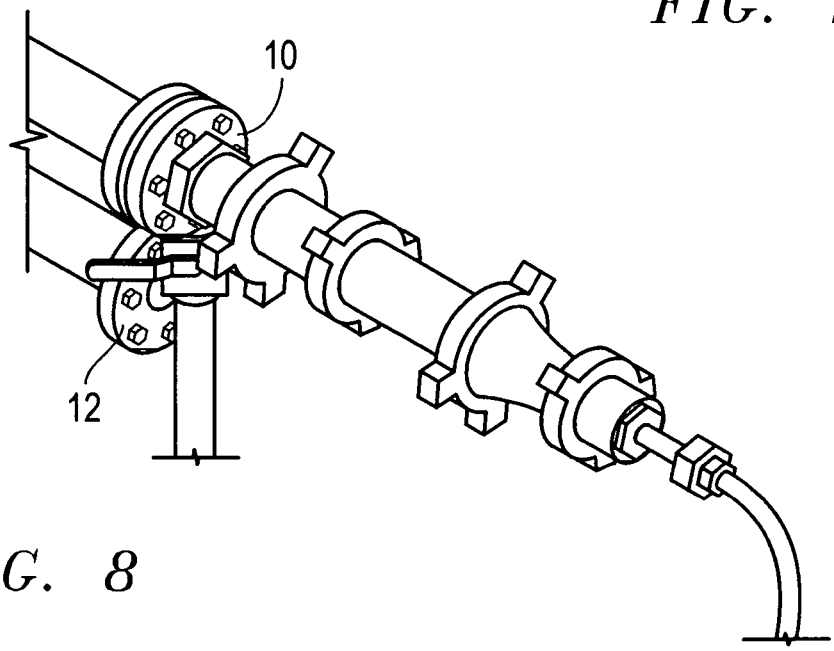
FIG. 8 is a close-up drawing of an embodiment of the present invention showing the liquid carbon dioxide supply point for the sparger into a pipeline.

Referring to FIG. 8, the sparger supply 10 was tied directly into the Blackmere pumps 12 on the liquid carbon dioxide bulker. These pumps 12 are high volume pumps and create significant pulses in the liquid carbon dioxide supply 10. Accordingly, a better skid 12 design including a surge suppressor will help alleviate the jitter, noise, and vibrations of this embodiment.

Figure 9:
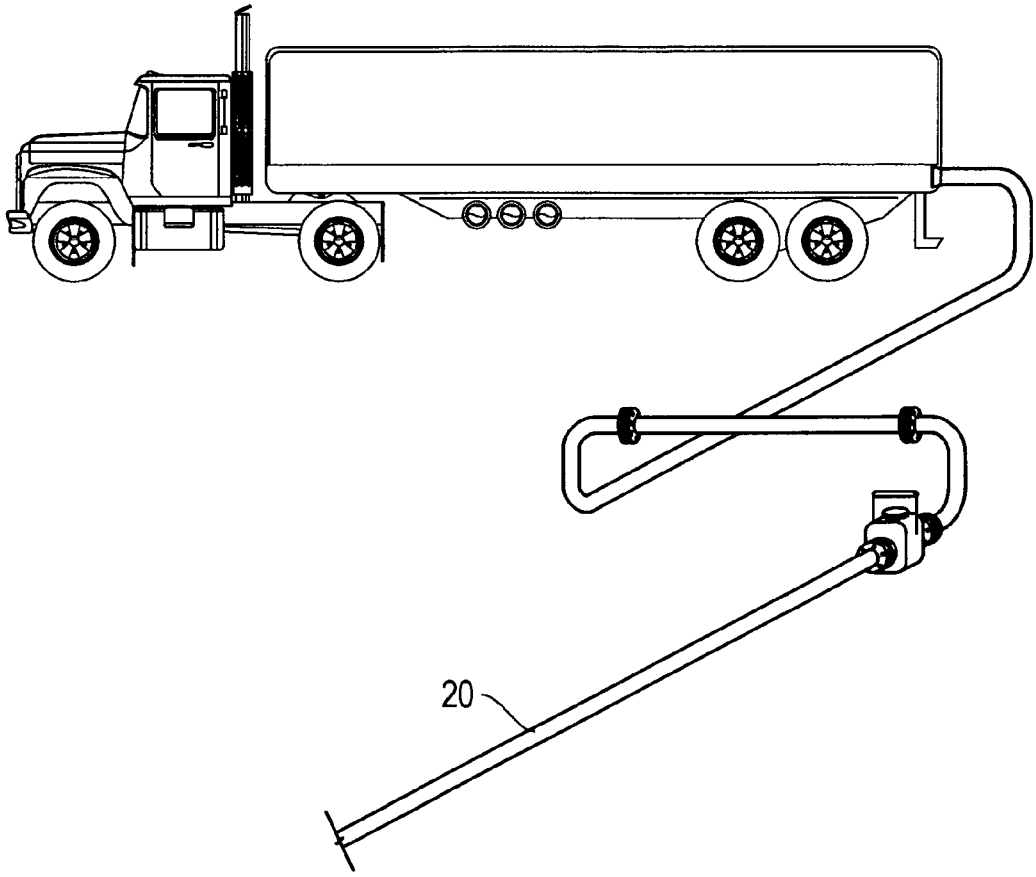
FIG. 9 is a drawing of an embodiment of a nitrogen supply that may be used with the present invention.
Figure 10:
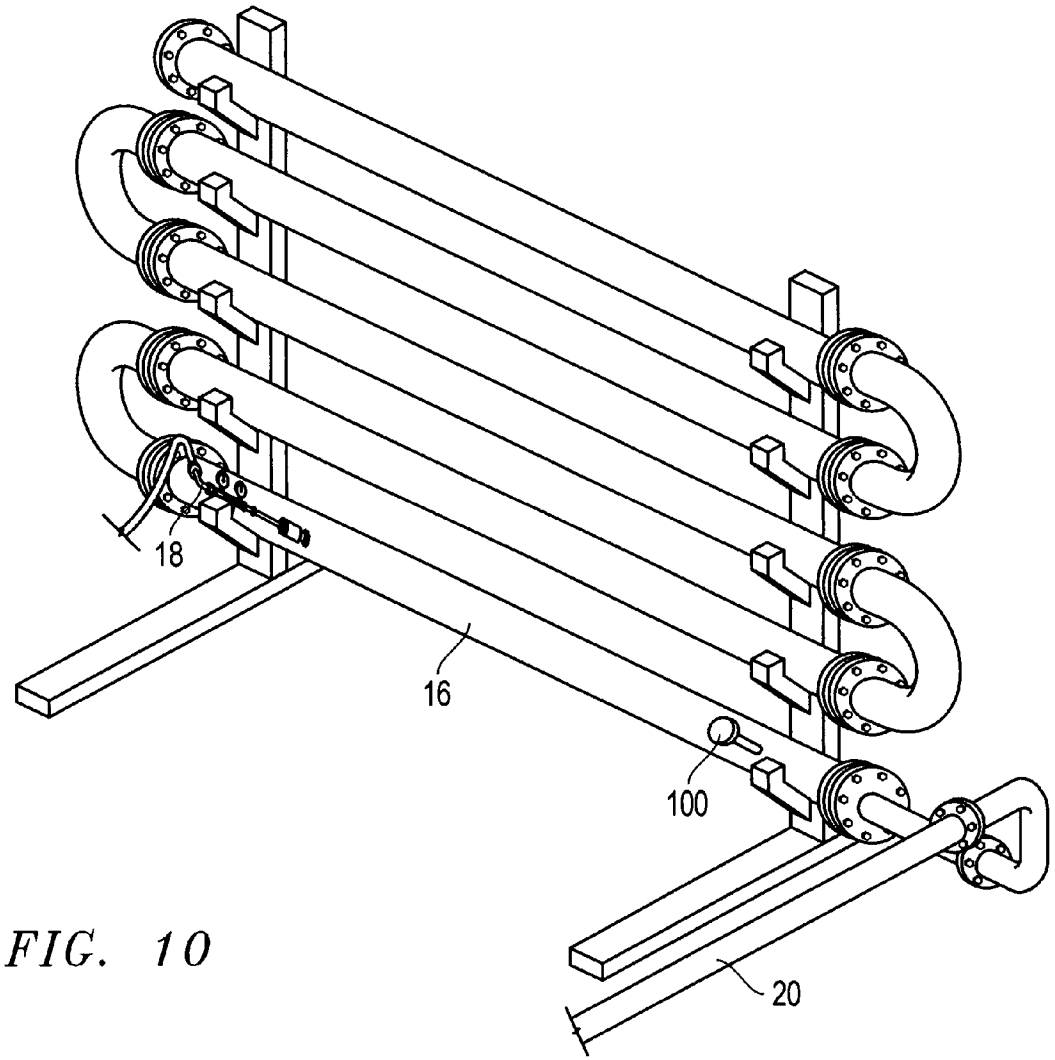
FIG. 10 is a drawing of an embodiment showing nitrogen and liquid carbon dioxide supplies to be used with the present invention.

Turning to FIGS. 9–10, nitrogen was supplied as the system gas in line in 20. Injection temperatures in this experiment were varied from about 40 to about 85° C. and flow rate between about 20 and about 80 $m^3$/min. Of note, this embodiment shows a temperature gauge 100 upstream of the sparger 18 on pipeline 16. The temperatures downstream of the sparger were recorded using a calibrated infrared gun. This allowed for adjustments and experiments with the nozzle configuration as will be discussed in greater detail with respect to FIGS. 11–13.

For operation of the present invention without the formation of ice plugs, the system should be purged with carbon dioxide gas prior to start up of the cooldown process. After allowing the pressure to build up over about 60 psi, liquid carbon dioxide from the sparger inserted into the pipeline may introduced. After cooldown is complete and shutdown of the cooling process is desired, the operator introduces carbon dioxide gas at the same pressure, over about 60 psi, preferably over about 90 psi, to purge the system of all liquids and then depressurize the gas.

Figure 11:
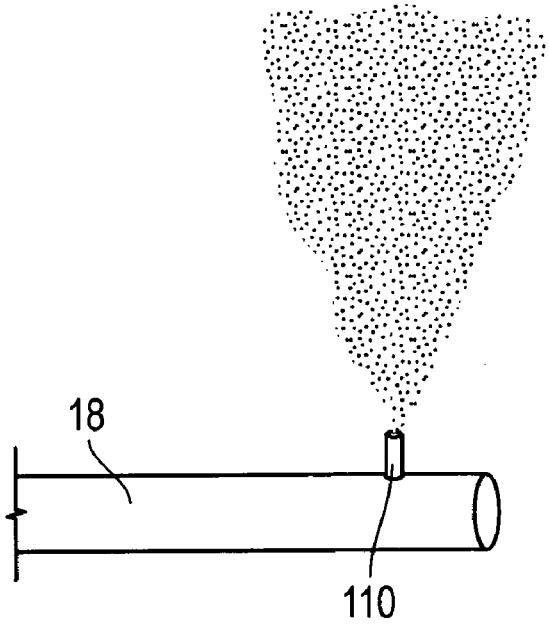
FIG. 11 is a drawing of an embodiment of a single nozzle sparger configuration.
Figure 12:
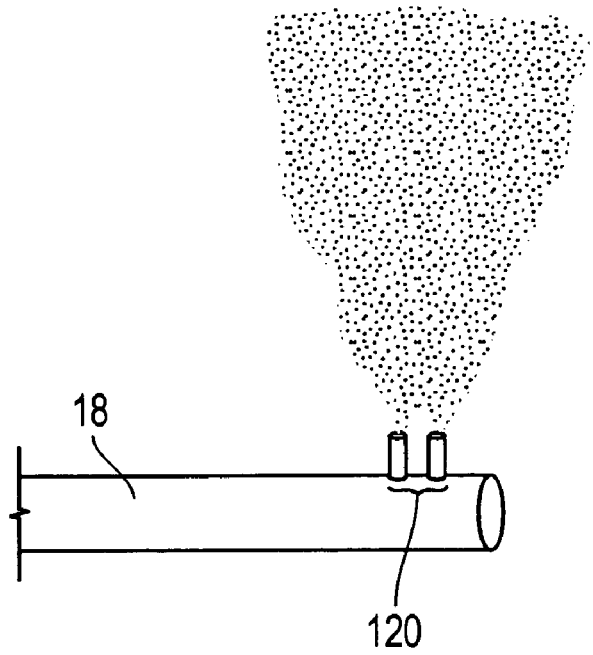
FIG. 12 is a drawing of an embodiment of a double nozzle sparger configuration.
Figure 13:
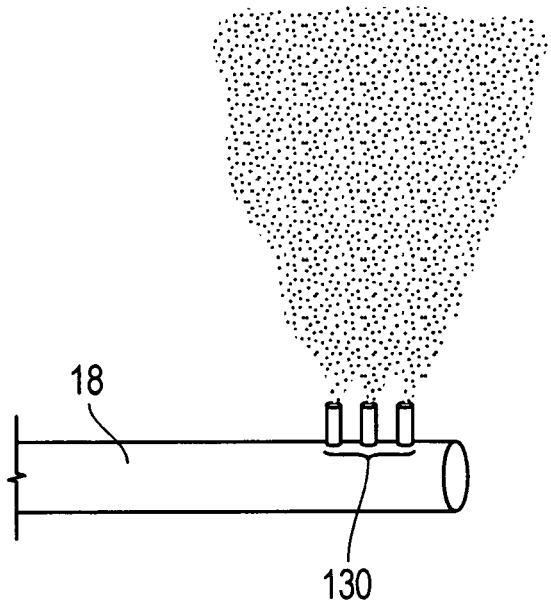
FIG. 13 is a drawing of an embodiment of a triple nozzle sparger configuration.

The configuration and number of nozzles on the sparger 18 is dependent on the configuration of the pipeline 16 and the type and pressure of the system gas through the pipeline 16. Moreover the rate and specific heat of the system gas affects the number and configuration of the nozzle or nozzles to be incorporated into the sparger 18. For example as shown in FIG. 11, a nozzle 110 is shown on the sparger 18. If more liquid carbon dioxide needs to be introduced into the system gas, additional nozzles may be formed in the sparger 18. FIG. 12 shows a sparger 18 with two nozzles 120 that allow for a greater flow and distribution of liquid carbon dioxide to be distributed into a pipeline. Those skilled in the art will recognize that a plurality of nozzles, such as the embodiment shown in FIG. 13, showing three nozzles 130 on sparger 18, is within the scope of the present invention.

The nozzles may sparge liquid carbon dioxide into and/or with the flow of system gas. It is envisioned that any configuration other than sparging liquid carbon dioxide onto the interior surface of the pipeline is beneficial. In a preferred embodiment, the nozzles for less than about a 45 degree angle either with or against the flow direction of the system gas. In a more preferred embodiment, the nozzles for less than about a 15 degree angle either with or against the flow direction of the system gas.

Figure 14:
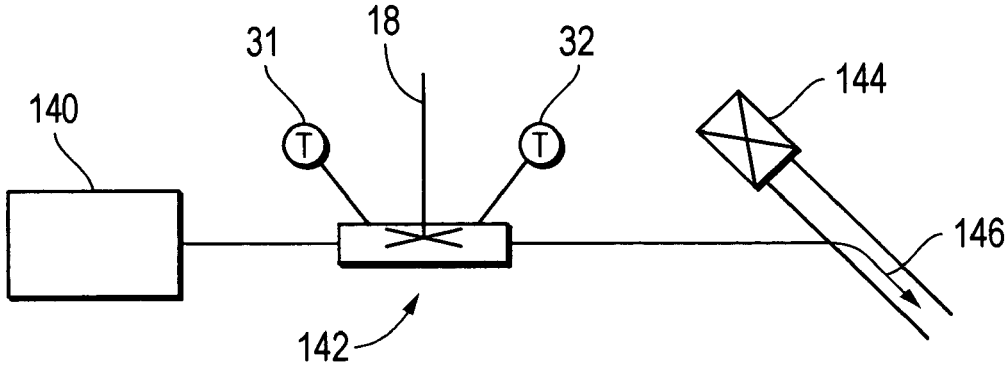
FIG. 14 is a drawing of an embodiment of an indirect liquid carbon dioxide system.

Moreover, it is envisioned that the concepts of this invention may employ an indirect liquid carbon dioxide system to facilitate the accelerated cooldown of a reactor as shown in FIG. 14. The arrangement allows for a temporary gas coming from a temporary gas source 140 to be sparged with liquid carbon dioxide to a controlled temperature as low as about −50° C. in a temporary iron 142 via an access valve connection. As shown herein a closed valve 144 is shown at the top of a gas passage 146, wherein the chilled gas flow may enter the reactor for the accelerated cooldown during the shutdown. As previously discussed, the sparger 18 comprises at least one nozzle positioned within the pipeline. Those skilled in the art will recognize that these types of variations in the arrangement of the elements of the invention are considered to be within the scope of the invention.

Having described the invention above, various modifications of the techniques, procedures, material and equipment will be apparent to those in the art. It is intended that all such variations within the scope and spirit of the appended claims be embraced thereby.

What is claimed is:

1. A system for the accelerated cooldown of at least one reactor comprising:

a pipeline connected to the reactor having at least one access valve wherein the pipeline is upstream of the reactor and routes a flow of system gas to the reactor;

a sparger inserted into the access valve, wherein the sparger comprises at least one nozzle positioned within the pipeline;

a source of liquid carbon dioxide capable of being delivered into the pipeline via the sparger wherein the liquid carbon dioxide is evenly distributed in the flow of system gas prior to entry into the reactor; and at least one temperature gauge in contact with the pipeline between the access valve and the reactor.

2. The system of claim 1 wherein the sparger further comprises a flow meter.

3. The system of claim 1 further comprising a pump capable of pumping the liquid carbon dioxide from the source to the sparger.

4. The system of claim 3 further comprising an injection skid connected between the pump and the sparger.

5. The system of claim 1 further comprising a pressure indicator connected to the sparger.

6. The system of claim 1 wherein the sparger further comprises a plurality of nozzles positioned within the pipeline.

7. The system of claim 1 wherein at least one nozzle is positioned with the flow of system gas.

8. The system of claim 1 wherein at least one nozzle is positioned against the flow of system gas.

9. The system of claim 1 further comprising:

a plurality of reactors in series by a plurality of pipelines, wherein each pipeline has at least one access valve;

a plurality of spargers inserted into each access valve, wherein each sparger comprises at least one nozzle positioned within each pipeline;

a source of liquid carbon dioxide capable of being delivered into each pipeline via each sparger wherein the liquid carbon dioxide is evenly distributed in the flow of system gas prior to entry into each reactor.

10. A method of accelerating the cooldown of at least one reactor, wherein the reactor has a pipeline connected to the reactor having at least one access valve and wherein the pipeline is upstream of the reactor and routes a flow of system gas to the reactor, the method which comprises the steps of:

(a) injecting a sparger into the access valve, wherein the sparger comprises at least one nozzle;

(b) positioning the nozzle within the pipeline;

(c) delivering a source of liquid carbon dioxide to the sparger; and (d) sparging the liquid carbon dioxide into the flow of system gas such that carbon dioxide is evenly distributed in the flow of system gas prior to entry into the reactor.

11. The method of claim 10 which further comprises the step of:

(e) monitoring a temperature of the pipeline prior to the connection with the reactor.

12. The method of claim 10 which further comprises the step of:

monitoring a flow rate of the liquid carbon dioxide passing through the sparger.

13. The method of claim 10 which further comprises the step of:

pumping the liquid carbon dioxide from the source to the sparger using a pump.

14. The method of claim 13 which further comprises the step of:

connecting a surge suppressor between the pump and the sparger.

15. The method of claim 10, wherein a plurality of reactors exist and wherein each reactor has a pipeline connected to that reactor having at least one access valve, the method which comprises the steps of:

(a) injecting a sparger into each access valve, wherein each sparger comprises at least one nozzle;

(b) positioning each nozzle within each pipeline;

(c) delivering a source of liquid carbon dioxide to each sparger; and (d) sparging the liquid carbon dioxide into the flow of system gas such that carbon dioxide is evenly distributed in the flow of system gas prior to entry into each reactor.

16. A system for the systematic cooldown of a series of reactors comprising:

a plurality of reactors in series by a plurality of pipelines, wherein each pipeline has at least one access valve;

a plurality of spargers inserted into each access valve, wherein each sparger comprises at least one nozzle positioned within each pipeline;

a source of liquid carbon dioxide capable of being delivered into each pipeline via each sparger wherein the liquid carbon dioxide is evenly distributed in the flow of system gas prior to entry into the reactor; and a plurality of pumps connected between the source and each sparger, wherein each pump is capable of pumping the liquid carbon dioxide to each sparger.

17. The system of claim 16 further comprising a plurality of injection skids for each pump, wherein each skid further comprises a surge suppressor connected between each pump and each sparger.

18. The system of claim 16 wherein each sparger further comprises a plurality of nozzles positioned within one of the pipelines.

19. The system of claim 16 wherein at least one nozzle is positioned with the flow of system gas.

20. The system of claim 16 wherein at least one nozzle is positioned against the flow of system gas.

* * * * *